US006371772B1

(12) United States Patent
Yoneyama et al.

(10) Patent No.: US 6,371,772 B1
(45) Date of Patent: Apr. 16, 2002

(54) ELECTRICAL CONNECTOR WITH ENHANCED CONTACTS

(75) Inventors: Atsushi Yoneyama, Nagano (JP); Hung-Chi Yu, Hsi-Chih (TW)

(73) Assignee: Hon Hai Precision Ind. Co., Ltd., Taipei Hsein (TW)

( * ) Notice: Subject to any disclaimer, the term of this patent is extended or adjusted under 35 U.S.C. 154(b) by 0 days.

(21) Appl. No.: 09/803,482

(22) Filed: Mar. 8, 2001

(30) Foreign Application Priority Data

Dec. 30, 2000 (TW) ..... 89222899 U

(51) Int. Cl.[7] ..... H01R 12/00
(52) U.S. Cl. ..... 439/79; 439/682
(58) Field of Search ..... 439/79, 80, 682, 439/733.1, 751, 852–857

(56) References Cited

U.S. PATENT DOCUMENTS 5,435,754 A * 7/1995 Hotea et al. ..... 439/854
5,860,838 A * 1/1999 Kaneko ..... 439/857
5,971,816 A * 10/1999 Chaillot ..... 439/852
6,171,126 B1 * 1/2001 Wu et al. ..... 439/733.1

* cited by examiner

*Primary Examiner*—Khiem Nguyen
(74) *Attorney, Agent, or Firm*—Wei Te Chung

(57) ABSTRACT

An electrical connector includes an insulative housing (30) and a plurality of contacts (10). The housing has a plurality of cavities (36) arranged in two vertical stacks (54, 56), each stack being separated by thin walls (34) of the housing. Each contact has a main body (11), a contact portion (12) for mating with a mating connector, and a mounting member (15) extending perpendicularly from the main body. The mounting member protrudes from a bottom surface (46) of the housing. A plate-like support finger (18) extends obliquely from the main body. The support finger has a suspending end (19) parallel to the main body and extending toward the mounting member. The suspending end bears against a lower wall of the corresponding cavity, thereby preventing the main body from moving downwardly relative to the contact.

11 Claims, 5 Drawing Sheets

ELECTRICAL CONNECTOR WITH ENHANCED CONTACTS

BACKGROUND OF THE INVENTION

1. Field of the Invention

The present invention relates to an electrical connector which has contacts for press-fitting onto a circuit board, and more particularly to an electrical connector for facilitating safe insertion of its contacts into the circuit board.

2. Description of the Related Art

A variety of electrical connectors have contacts engagable with through holes of a circuit board without requiring soldering. It is generally difficult to attach such connectors to a circuit board without special tools. The electrical connector disclosed in U.S. Pat. No. 5,490,787 seeks to overcome this difficulty. The connector is attached to a circuit board by applying an insertion force directly to a top surface of a housing thereof, instead of using a tool. The connector comprises the housing and a plurality of contacts. The housing has a plurality of cavities separated by thin walls. Each contact has a contact portion to mate with a mating connector, and a tail bending perpendicularly toward the circuit board and secured therein. Each contact also has a pair of support members extending from opposite edges of a body of the contact. The support members are bent to form a C-shape in conjunction with the body, to prevent the body from moving downwardly when the insertion force is applied.

Unfortunately, each support member is only in essentially linear contact with a lower wall of the cavity of the housing. Thus the support area is relatively small, and the support member cannot withstand a large insertion force. Downward movement of the body of the contact frequently occurs during attachment, resulting in damage to the contact. More over, the support member has a relatively complicated structure, resulting in more complex manufacturing and increased costs.

An electrical connector having enhanced contacts is desired to overcome the above-mentioned problems of the related art.

SUMMARY OF THE INVENTION

An object of the present invention is to provide an electrical connector having contacts with support fingers which minimize the risk of damage to the contacts during attachment of the connector to a circuit board.

Another object of the present invention is to provide an electrical connector which is firmly attachable to a circuit board and easily manufactured.

To achieve the above-mentioned objects, an electrical connector in accordance with the present invention is mountable to a mounting surface of a circuit board for being electrically connected to circuitry on the circuit board. The connector includes an insulative housing having a top surface and a bottom surface, and a plurality of contacts. The bottom surface is adapted to be mounted to the mounting surface. The housing has a plurality of spaced cavities formed therein, stacked vertically between the top and bottom surfaces and separated by a center wall and thin walls. Each cavity is thereby bounded by an upper wall and a lower wall.

A plurality of contacts is received in the housing, one contact in each respective cavity. Each contact has a horizontal main body, a contact portion extending from an end of the main body for receiving a pin contact of a mating connector, and a mounting member extending perpendicularly from an opposite end of the main body. The contact portion comprises an upper contact leaf and a lower contact leaf bent toward each other. An upper surface of the main body and an end of the lower contact leaf respectively abut against opposite lower and upper walls of the corresponding cavity. Each contact has a plate-like support finger extending obliquely from the main body. The support finger has a suspending end parallel to the main body and extending toward the mounting member, for bearing against the lower wall of the corresponding cavity. The main body is thereby prevented from moving downwardly relative to the contact.

Other objects, advantages and novel features of the invention will become more apparent from the following detailed description of a preferred embodiment thereof when taken in conjunction with the accompanying drawings, wherein:

DETAILED DESCRIPTION OF THE PREFERRED EMBODIMENT

Figure 1:
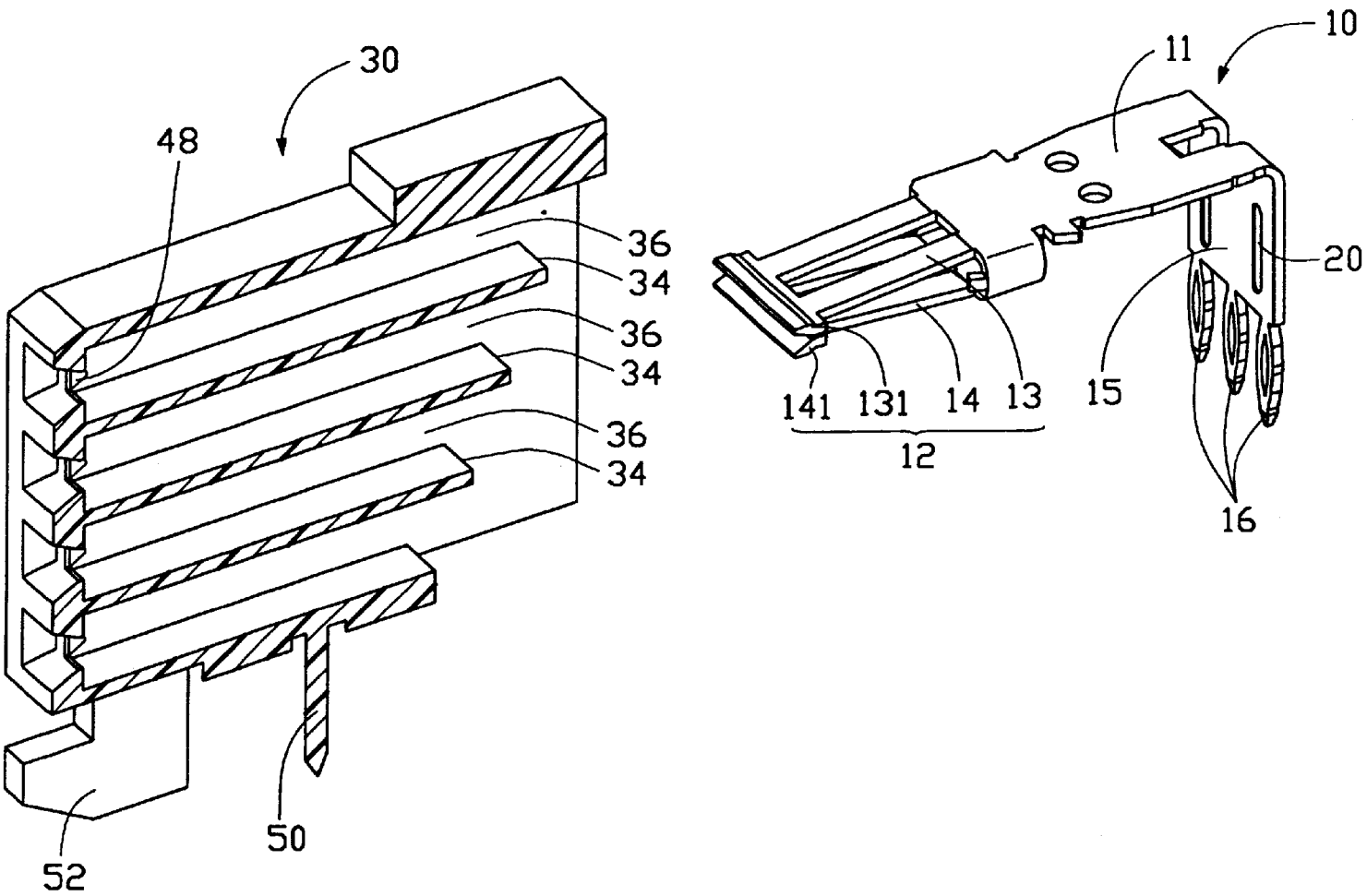
FIG. 1 is an exploded view of an insulative housing and a contact of an electrical connector in accordance with the present invention, showing a cutaway view of the housing thereof.
Figure 3:
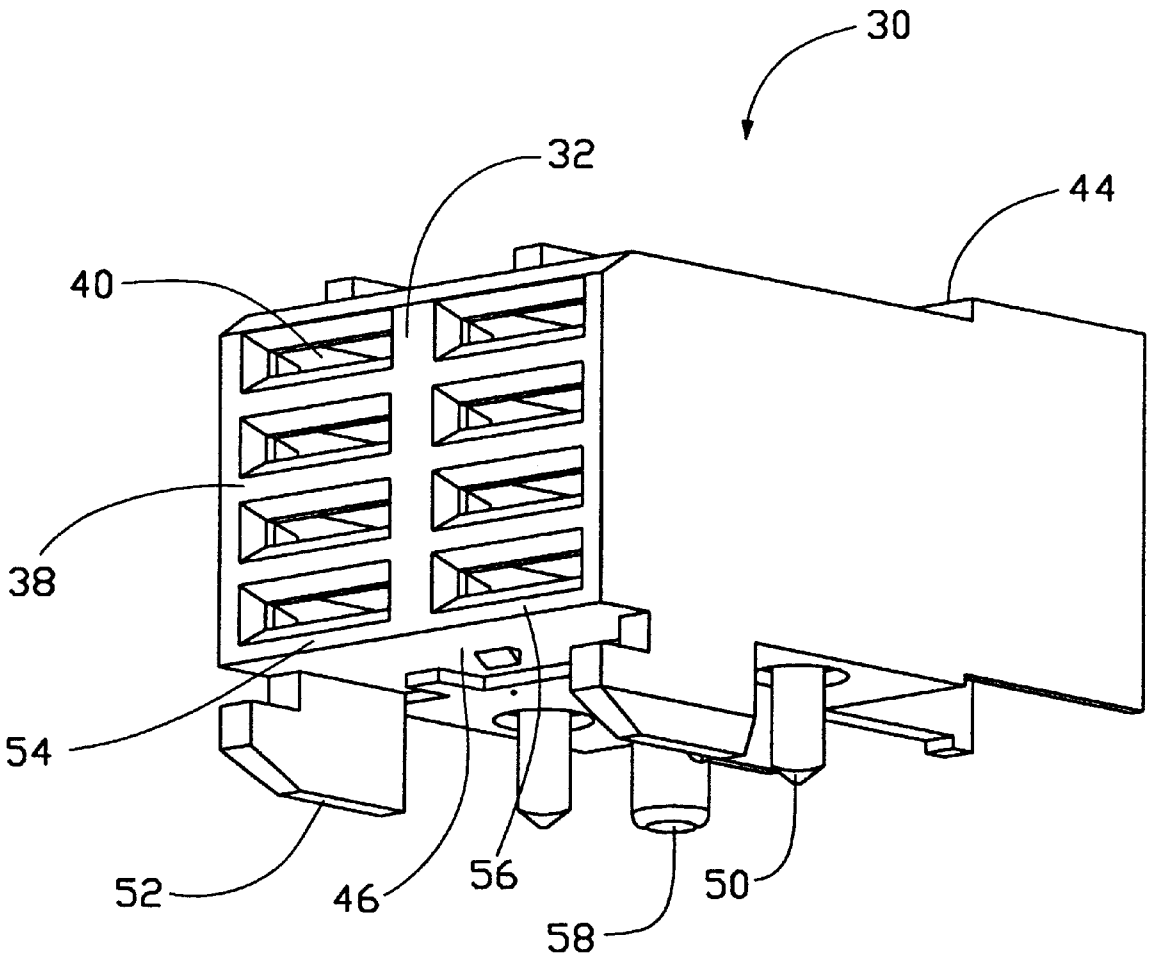
FIG. 3 is a perspective view of the housing of the electrical connector of FIG. 1.
Figure 4:
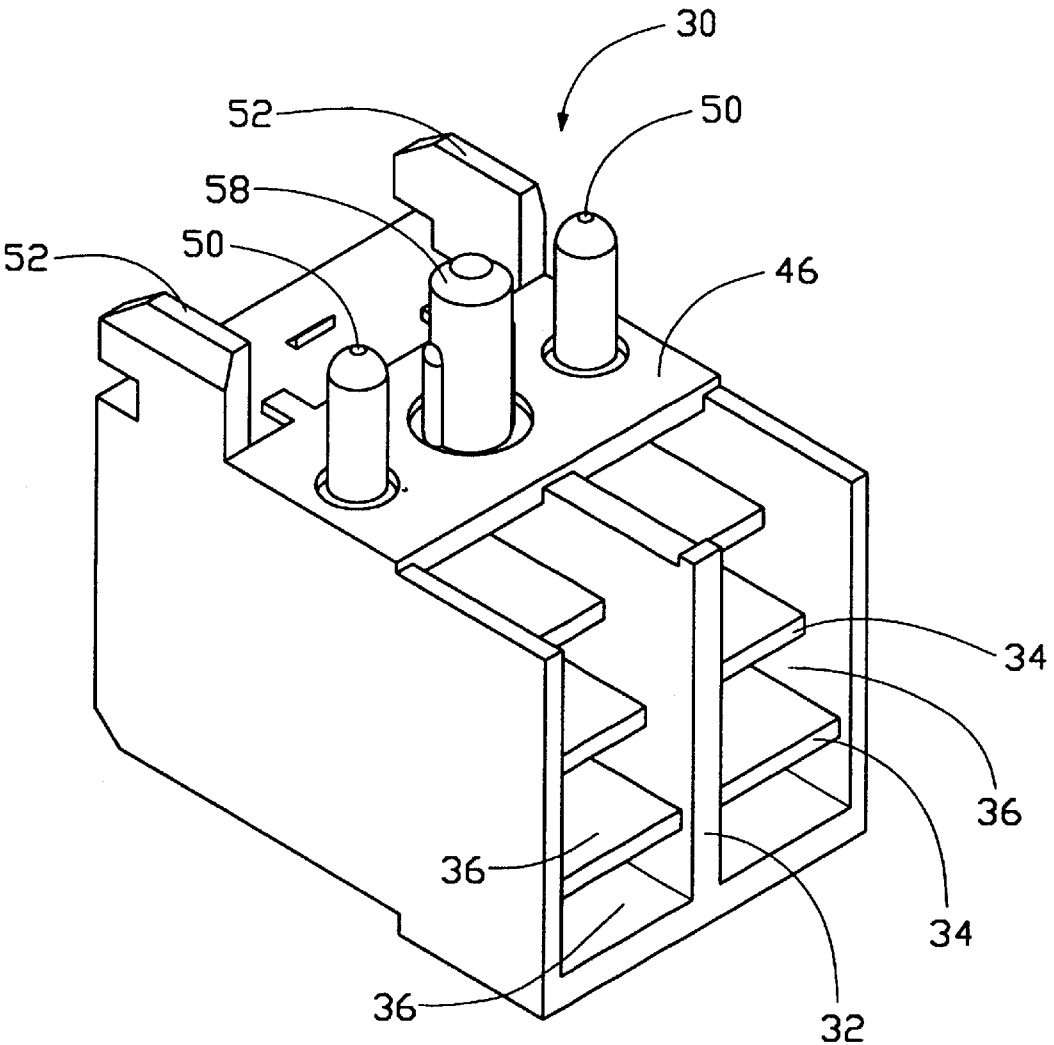
FIG. 4 is a perspective view of the housing of FIG. 3, wherein the housing is inverted.

Referring to FIG. 1, an electrical connector in accordance with the present invention includes an insulative housing 30 and a plurality of contacts 10. As shown in FIGS. 3 and 4, the housing 30 includes a generally flat top surface 44 and a generally flat bottom surface 46. The bottom surface 46 is adapted to be mounted to a mounting surface (not shown) of a circuit board. The housing 30 has a plurality of cavities 36 containing the contacts 10, best seen in FIG. 1. The cavities 36 are separated by thin walls 34 and a vertical center wall 32, and are arranged in two side by side vertical stacks 54, 56 between the top and bottom surfaces 44, 46. Each cavity 36 is thereby bounded by an upper wall (not labeled) and a lower wall (not labeled). Each cavity 36 is rectangular in cross section, and extends from a front wall 38 and to an open back (not labeled). Each cavity 36 has a rectangular opening 40 defined in the front wall 38, for receiving a pin contact (not shown) of a mating connector. Each opening 40 is smaller in dimensions than the cross-section of its corresponding cavity 36, and is centered relative to its corresponding cavity 36. A plurality of lugs 48 extends inwardly from an inner surface of the front wall 38, adjacent opposite side extremities of the openings 40 (best seen in FIG. 1). A pair of guide rails 52 extends from the bottom surface 46 adjacent the front wall 38, for being guided into the mating connector. Two spaced locating pins 50 extend from the bottom surface 46, and are sized to slip fit into locating holes (not shown) in the circuit board. The pins 50 accurately position the housing 30 with respect to the circuit board, and prevent sideways movement of the housing 30. A center pin 58 depends from the bottom surface 46 between the locating pins 50, for locking the connector onto the circuit board.

Figure 2:
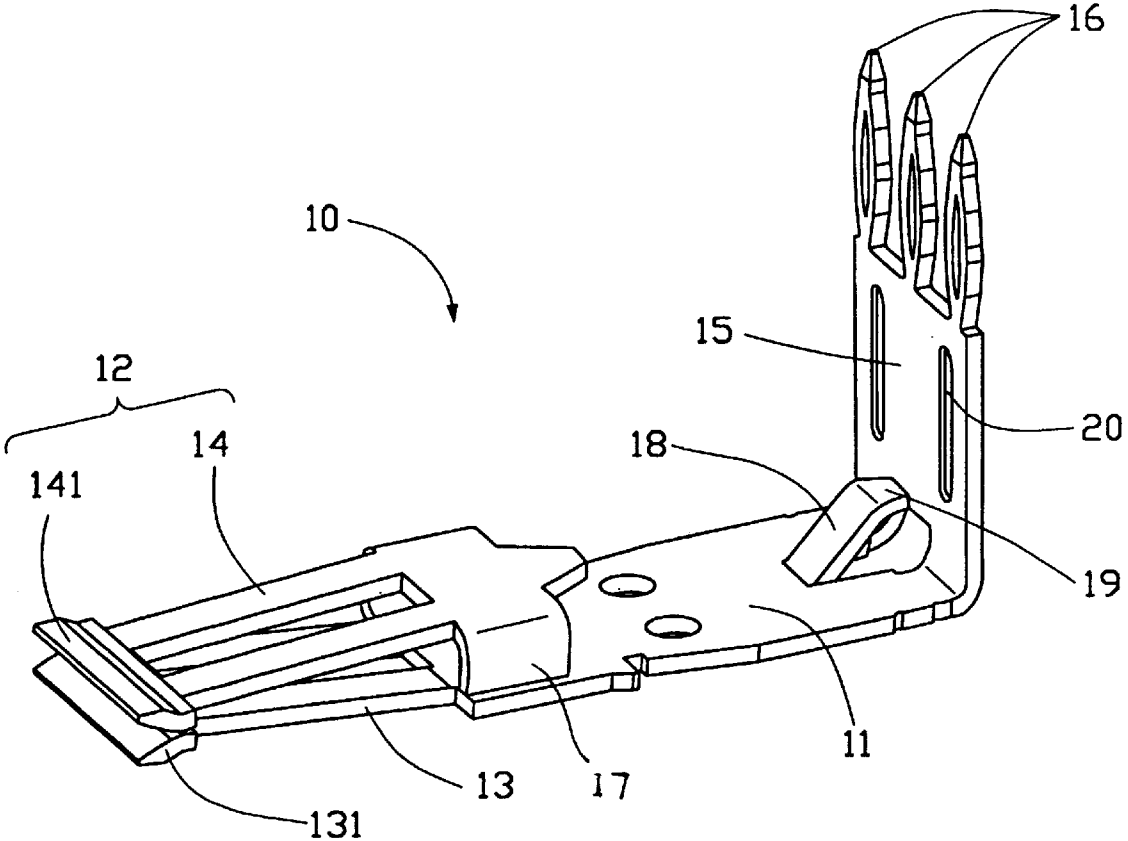
FIG. 2 is an enlarged perspective view of the contact of the electrical connector of FIG. 1, wherein the contact is inverted.

As shown in FIG. 2, each contact 10 is an integral body formed or punched from a sheet of material. Each contact 10 includes a horizontal main body 11, a contact portion 12 extending generally coplanarly from an end of the main body 11, and a mounting member 15 extending perpendicularly from an opposite end of the main body 11. A support portion 17 is formed on a joint portion of the main body 11 and the contact portion 12, and abuts against both the upper wall and the lower wall in the cavity 36. The contact portion 12 comprises an upper contact leaf 13 and a lower contact leaf 14 bent toward each other, for engaging with a pin contact (not labeled) of a mating connector. The upper and lower contact leaves 13, 14 each have a rectangular hole (not labeled) defined in a middle portion thereof. Upper and lower contact tabs 131, 141 respectively extend from distal ends of the upper and lower contact leaves 13, 14, and oppose each other. Three tails 16 extend from a distal end of the mounting member 15, for being inserted into corresponding holes (not shown) in the circuit board. Two reinforcing ribs 20 are formed in the middle of the mounting member 15, to withstand force which is applied on the contact 10 when the tails 16 are inserted into the circuit board. A substantially plate-like support finger 18 extends obliquely from the main body 11 toward the mounting member 15. The support finger 18 has a suspending end 19 parallel to the main body 11 and extending toward the mounting member 15.

Figure 5:
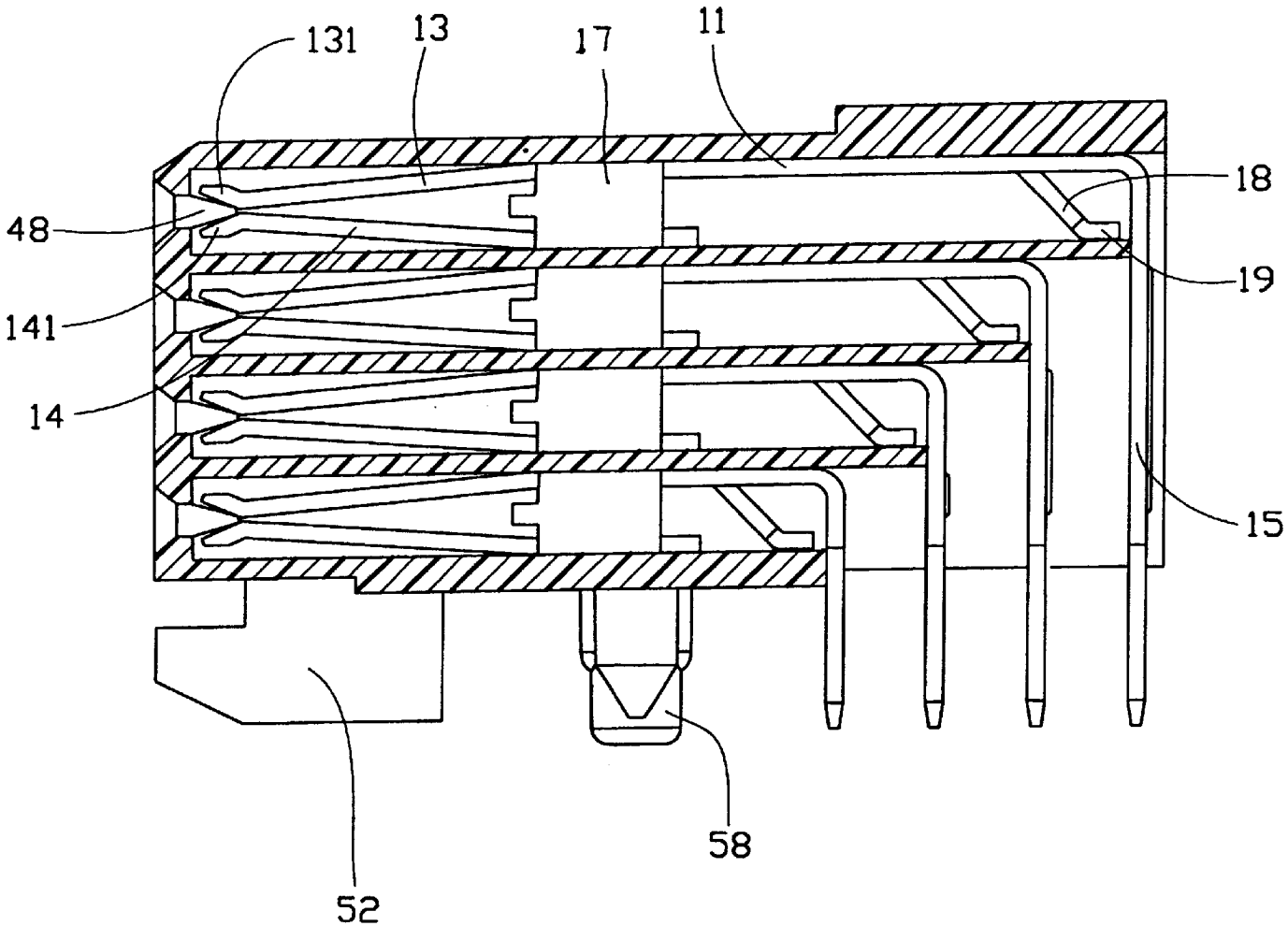
FIG. 5 is an assembled cross-sectional view of the electrical connector of FIG. 1.

As shown in FIG. 5, in assembly, the contacts 10 are inserted into the housing 30. The horizontal main body 11 and the contact portion 12 of each contact 10 are inserted from the open back (not labeled) of the housing 30. The mounting member 15 of each contact 10 abuts against an end of the corresponding thin wall 34. The tails 16 of the mounting member 15 protrude from the bottom surface 46 of the housing 30. An upper surface of the main body 11 of each contact 10 abuts against the upper wall (not labeled) of the corresponding cavity 36. An end of the lower contact leaf 14 adjacent the main body 11 abuts against the lower wall (not labeled) of the said corresponding cavity 36. Thus the main body 11 is pressed between the upper and lower walls, and the contact 10 is firmly secured to the housing 30. The lugs 48 pre-load the upper and lower contact tabs 131, 141. The suspending end 19 of the support finger 18 bears against the lower wall of the cavity 36, thereby preventing the main body 11 from moving downwardly relative to the contact 10. When one pin contact (not labeled) of the mating connector is inserted into one of the cavities 36 from the opening 40, the upper and lower contact tabs 131, 141 sandwich the pin contact therebetween and electrically communicate with it.

It is understood that the invention may be embodied in other forms without departing from the spirit thereof. Thus, the present examples and embodiment are to be considered in all respects as illustrative and not restrictive, and the invention is not to be limited to the details given herein.

We claim:

1. An electrical connector for mounting to a mounting surface of a circuit board and being connected to circuitry on the circuit board, the connector comprising:

an insulative housing having a top surface and a bottom surface, the bottom surface being adapted to be mounted to the mounting surface of the circuit board, the housing having a plurality of spaced cavities defined therein, the cavities being between the top and bottom surfaces and being separated by a center wall and thin walls so that each cavity is bounded by an upper wall and a lower wall; and a plurality of contacts being respectively received in the corresponding cavities, each contact including a main body, a contact portion extending from an end of the main body, a mounting member extending perpendicularly from an opposite end of the main body, and a support finger extending obliquely from the main body to bear against the corresponding upper wall, thereby preventing the main body from moving downwardly relative to the contact.

2. The electrical connector according to claim 1, wherein the support finger of each contact is plate-like, and extends obliquely from the main body toward the mounting member.

3. The electrical connector according to claim 1, wherein a suspending end of the support finger extends parallel to the main body.

4. The electrical connector according to claim 1, wherein the contact portion of each contact comprises an upper contact leaf and a lower contact leaf bent toward each other.

5. The electrical connector according to claim 1, wherein an upper surface of the main body of each contact abuts against the upper wall of the corresponding cavity of the housing, and an end of the lower contact leaf adjacent the main body abuts against the lower wall of the said corresponding cavity.

6. The electrical connector according to claim 4, wherein each upper and lower contact leaf respectively has an upper contact tab and a lower contact tab, the upper and lower contact tabs opposing each other.

7. The electrical connector according to claim 6, wherein a plurality of lugs extends inwardly from the housing, for preloading the upper and lower contact tabs.

8. The electrical connector according to claim 1, wherein at least one tail extends from the mounting member of the contact, and at least one reinforcing rib is formed in the mounting member.

9. The electrical connector according to claim 1, wherein the cavities of the housing are stacked vertically between the top and bottom surfaces of the housing.

10. An electrical connector comprising:

an insulative housing defines plural rows of cavities, each of said cavities defined between corresponding opposite first and second walls thereabouts;

a plurality of contacts respectively received within said corresponding cavities, each of said contacts including a main body with a contact portion and a mounting member on opposite ends thereof; wherein said main body abuts against the first wall, a support portion abuts against both the first and second walls, and a support finger extending from the main body abuts against the second wall.

11. The connector according to claim 10, wherein said mounting member is downwardly and perpendicularly bent from the main body, and said finger is formed adjacent to a joint portion between said main body and said mounting member.

* * * * *